United States Patent [19]

Dassler

[11] 4,283,865

[45] Aug. 18, 1981

[54] OUTSOLE FOR SPORT SHOES

[76] Inventor: Adolf Dassler, Kreuzgasse, D-8522 Herzogenaurach, Fed. Rep. of Germany

[21] Appl. No.: 56,601

[22] Filed: Jul. 11, 1979

Related U.S. Application Data

[62] Division of Ser. No. 884,484, Mar. 8, 1978, Pat. No. 4,180,923.

[30] Foreign Application Priority Data

Jan. 18, 1978 [DE] Fed. Rep. of Germany ..... 2801964

[51] Int. Cl.[3] ..... A43B 13/04

[52] U.S. Cl. ..... 36/32 R; 36/59 C; 36/59 R

[58] Field of Search ..... 36/32 R, 59 R, 59 C, 36/67 R, 67 A, 67 D, 134; D2/320

[56] References Cited

U.S. PATENT DOCUMENTS

| | | | |
|---|---|---|---|
| D. 112,429 | 12/1938 | Tebbutt | D2/320 |
| D. 119,290 | 3/1940 | Watanabe | D2/320 |
| D. 119,291 | 3/1940 | Watanabe | D2/320 |
| D. 146,505 | 3/1947 | Kavenagh | D2/320 |
| 2,433,303 | 12/1947 | Spini | 36/59 C |
| 3,063,171 | 11/1963 | Hollander | 36/134 |

FOREIGN PATENT DOCUMENTS

| | | | |
|---|---|---|---|
| 666231 | 11/1965 | Belgium | 36/32 R |
| 2618588 | 11/1977 | Fed. Rep. of Germany | 36/59 R |
| 419410 | 3/1947 | Italy | 36/59 C |
| 224626 | 3/1943 | Switzerland | 36/59 R |

OTHER PUBLICATIONS

Rubber-Cleated Soles and Heels-periodical unknown, Nov. 1943.

*Primary Examiner*—James Kee Chi

[57] ABSTRACT

An outsole for a sports shoe which enables it to be used for a wider range of different types of ground than is possible with the known outsoles. The sole is provided with profile projections which are each formed by at least two elongate profile bodies which are close together or joined at one end and diverge towards the other end to radiate on one side only of the projection. The projections when stressed counter to the direction of divergence of the profile bodies provide increased support, but provide less support when stressed in the opposite direction. This is particularly true if the profile bodies are constructed of a springily resilient material. By appropriately arranging the profile bodies on the outsole, controlled account can be taken of the requirements in respect of safety against slipping and the sliding characteristics, of the sport shoe.

1 Claim, 4 Drawing Figures

Figure 1:
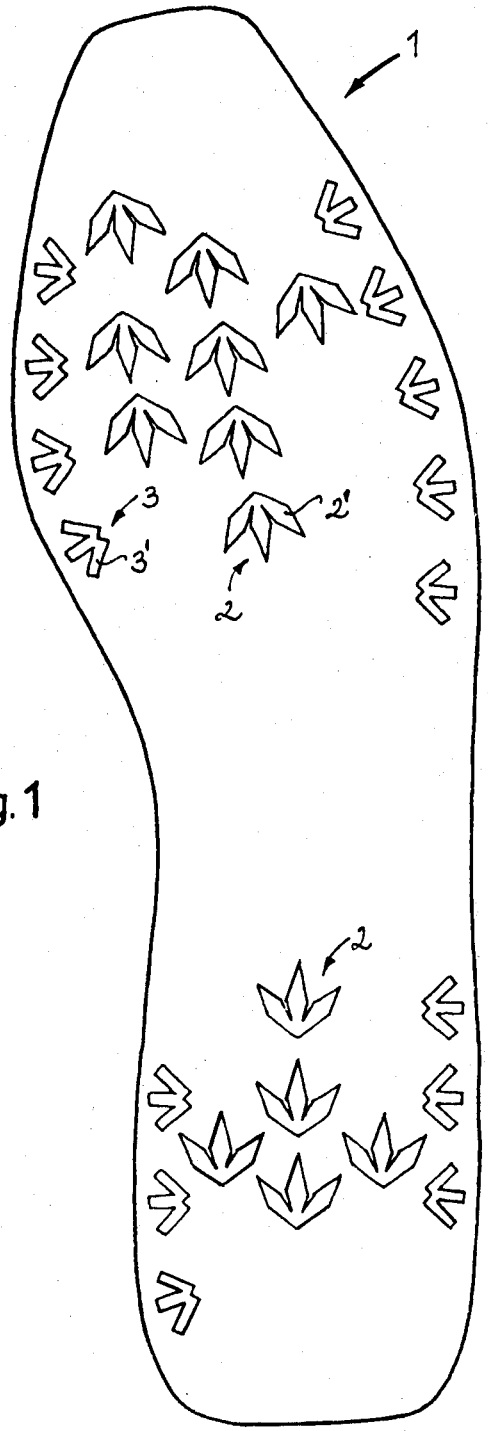

Fig. 2
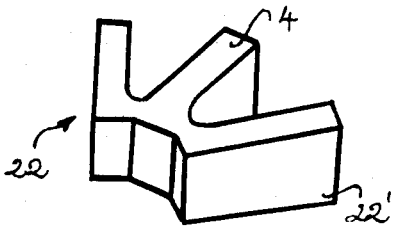
Fig. 3
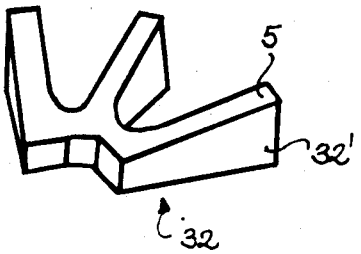
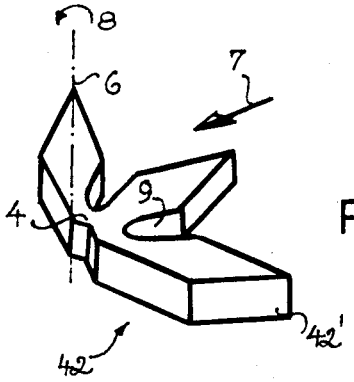
Fig. 4

OUTSOLE FOR SPORT SHOES

This is a division of application Ser. No. 884,484, filed Mar. 8, 1978, now U.S. Pat. No. 4,180,923.

The invention relates to an outsole for sport shoes with profile projections located on the outer face.

A large number of different profile projections on the outsole of sport shoes, so-called "sole profiles", are known. The object of the profile projections is to provide safety when standing and security against slipping, and, when running, to transmit the force exerted by the leg of the athlete to the ground, with as little loss as possible. The nature of the outsole of the sport shoe and especially its profiling depends on the nature of the ground over which the athlete moves. It is true that for a long time endeavours have been made to achieve a universal profile of sport shoes, which can be used with equal effect on a great diversity of grounds, and indeed profiles have also been found which permit sport shoes to be used on a variety of grounds. However, it has not hitherto proved possible so to design the profiling of outsoles for sport shoes that the latter can be used with equal advantage both on soft resilient ground, for example on grass, and on hard rough ground, for example carpeted ground, or on a hard smooth ground, for example the floor of a sports hall, without exhibiting disadvantages in one respect of another. If, for example, the profile projections are relatively high, as is the case, for example, for the studs or a football boot, they are, admittedly, suitable for use on soft ground, but are unusable for all other types of sport performed on hard ground. If a springily resilient material, of which, for example, the outsole of the sport shoe itself consists, is used for these studs, it is admittedly in principle possible to use the shoe on hard ground. However, the safety when standing with such profiles, is very low, since the height of the studs conveys a floating sensation because of the soft resilient material used. Conversely, sole profiles of which the individual profile projections are only slightly raised from the outer face of the sole and which consist of relatively soft resilient material are very suitable for smooth hard floors in sports halls. This is because, due to the relatively small height of the profile projections, the athlete stands securely in spite of the soft sole material, since deformations of the profile bodies, which might cause a floating sensation, are hardly significant. On the other hand, however, the profile projections consisting of soft resilient material can press into even the slightest unevennesses of the ground and also result in a very high frictional contact which is important for security against slipping and especially for a secure stride.

The security against slipping provided by the sole profiling must on the other hand not be so great that the athlete is checked too abruptly when he stops. If this happens, the stress on the parts of the body which generate the athlete's movement is extremely high, so that injuries, or damage to health caused by stress over long periods, may result.

It is the object of the invention to provide an outsole with a profiling which makes it possible to extend the range of usefulness of sport shoes, equipped therewith, on different grounds to a greater extent than hitherto. In addition, on stopping, the outsole should have a slight and limited ability to slip, in order to prevent excessive stress on the parts of the body of the athlete which generate his movement.

According to the invention, this object is achieved if the profile projections of the outsole are formed by at least two elongate profile bodies, which in each case are located close to one another at one end and diverge from one another from this end, the bodies of a profile projection all radiating on one side only of the profile projection.

The profile projections of the outsole according to the invention are thus composed of at least two and preferably three elongate profile bodies which are in no way arranged with rotational symmetry but extend in each case towards one side. Accordingly, the description "towards one side" used above for the arrangement of the profile bodies is to be understood to means that the profile bodies lie within an angular range of at most 180°. However, they do not run parallel but form, with one another, small acute angles, that is to say they diverge or radiate from one another. Preferably there are no more than four or at most five elongate profile bodies. It has now been found that with such a design the profile projections can be of relatively small height but do display a good gripping action, is the manner of studs, on soft ground. At the same time, however their tread surfaces can be kept relatively large and they can consist of a springily resilient material, for example rubber, so that they can be used even on smooth and hard ground. Both on penetrating into soft ground and on resting on hard ground the profile projections, when subjected to stress counter to the direction of divergence of the individual profile bodies, undergo a splaying effect which increases the security against slipping. This splaying effect arises from the fact that the individual profile bodies, consisting of deformable material, of each profile projection tilt slightly outwards under stress and as a result show a tendency to increase the engagement surface in the direction of the stress whilst on being stressed in the opposite direction the converse effect occurs.

The construction of the profile projections out of three or four elongate profile bodies has the advantage, over the construction with two profile bodies, that for the same tread surface the profile bodies can be kept finer and hence more ready to tilt, so that the said splaying effect manifests itself more clearly. However, the construction of the profile projections from more than four profile bodies produces no further advantage, because then the spacing of the finger-shaped profile bodies is so small that firm adhesion of accumulated dirt is unavoidable.

In principle it is possible to locate the profile projections according to the invention in a detachable manner on the outsole of the sport shoe. However, advantageously the profile projections are moulded, for example injection moulded, from the material of the sole and integrally with the outsole. Suitable materials are the conventional springily resilient sole materials, such as PVC, polyurethane, rubber and the like.

In order that the invention will be more readily understood, the following description is given, merely by way of example, reference being made to the accompanying drawings, in which:

FIG. 1 is a bottom view of one embodiment of outsole, according to the invention, with two different forms of profile projections; and FIGS. 2 to 4 are perspective views of various embodiments of the profile projections usable in an outsole according to the invention, on a greatly enlarged scale.

The outsole of which a bottom view is shown in FIG. 1 is intended for a sports shoe which is suitable both for running on hard tracks, such as roads, and for running through woods and cross-country running. In addition, the sport shoe can be employed, without any disadvantage, on smooth sports hall floors. The outsole marked 1 in its entirety consists of one of the common sole materials, such as PVC, foam polyurethane, rubber or the like and is either glued to, or directly moulded onto, the upper of the sports shoe.

The outsole 1 carries integrally moulded-on profile projections 2, 3, which have the common characteristic that they are formed by three essentially elongate profile bodies 2', 3', which are joined together at one end whilst their other ends diverge or radiate from the junction point towards one side. The main surface of the front sole is provided with the larger profile projections 2, of which the profile bodies 2' have a slender rhombic or lozenge-shaped outline. The arrangement of the profile projections is such that the profile bodies 2' extend in a generally rearward direction. On the rear sole, precisely the converse arrangement of the profile projections 2 is provided. There, the profile bodies 2' diverge forwards. The profile projections 3 are somewhat smaller and the profile bodies 3' have a rectangular outline. The profile projections 3 are only located along the edge of the sole and are oriented so that the profile bodies 3' in each case diverge or radite outwards.

The distribution of the profile projections 2, 3 shown in FIG. 1 is, for the sake of clarity of the drawing, not complete; instead, it is to be understood that the profile projections, of the pattern shown, are distributed uniformly over the entire sole surface and in addition profile projections of different shape may also be provided. Furthermore, instead of the profile projections 3 located in the region of the edge of the sole, the profile projections 2, if appropriate in a smaller version can be provided.

FIGS. 2 to 4 show, on a greatly enlarged scale, various embodiments of profile projections such as are provided, in a similar form, on the outsole 1 according to FIG. 1.

In the profile projection 22 according to FIG. 2, the three profile bodies 22' have a slender rectangular outline and are of constant height over their entire length. As a result, their tread surface 4 is substantially parallel to the outer face (which is not shown) of the outsole 1. The individual profile bodies 22' subtend an angle of about 35° to 40°.

The profile projection 32 shown in FIG. 3 corresponds in outline substantially to that of FIG. 2. However, the height of the profile bodies 32', at the end at which they are joined to one another, is only half as great as at the other end, so that a tread surface 5 which rises from the outsole at an angle in the direction of divergence of the profile bodies 32' results.

The profile bodies 42' of the profile projection 42 according to FIG. 4 have the outline of a slender regular lozenge or rhombus. Here again the individual profile bodies 42' are equiangularly arranged, as in the embodiments according to FIGS. 2 and 3, so that the two outer profile bodies 42' are located symmetrically to the central axis of the middle profile body. Because of the rhombic outline, the profile bodies 42' terminate, at both ends, in a sharp edge which however is only pronounced at the free end, whilst due to the joining together of the profile bodies 42' obtuse edges result at the other end. The tapering and termination in a sharp edge assist the deformability of the profile body 42' and its tendency to tip about its longitudinal axis 6 which in FIG. 4 is indicated for one of the profile bodies 42'. The tendency to tip which produces the splaying effect described earlier, is to be expected if a force acts in the direction of the arrow 7, the splaying being indicated by the arrow 8.

In FIG. 4, a pronounced recess 9 may be seen between each of the outer profile bodies 42' and the middle profile body, which recess also assists the tendency of the profile bodies to tip. However, the recess is not absolutely essential since the tapering of the profile bodies 42' in itself already results in a sufficient splaying effect. Instead of this recess, it is possible for all three profile bodies to be joined up to the middle edge of the lozenge, so that this results in a substantially greater tread surface 4 of the profile projection.

It is a feature common to the profile projections according to FIGS. 2 to 4 that their lateral delimiting surfaces are substantially at right angles to the outer face of the outsole 1, so that when they are used on soft ground they display the gripping character of studs. Furthermore, they have a relatively large tread surface 4 or 5, the main surface of which lies in the region of the joined ends of the profile bodies. This part of the tread surface is particularly load-bearing when the outsole is used on hard ground and also in a sense acts as a slide surface if the particular profile projection is stressed in a direction in which the splaying effect described does not manifest itself. The function as a slide surface becomes particularly advantageous when, in accordance with the illustrative embodiment in FIG. 3, the tread surface 5 rises from the joined ends of the profile bodies . . . in the direction of the other ends, that is to say extends slopingly out from the outer face of the outsole 1. It will be understood that all embodiments of the profile projection according to FIGS. 2 to 4 can correspondingly be provided with a sloping tread surface 5.

In the case of the outsole shown in FIG. 1, it is advantageous to construct the profile projections 2, 3 located in the inner ball region, with a tread surface 4 which is parallel to the outer face of the sole. The remaining profile projections 2, 3 can have a sloping tread surface 5. This measure assists the turning characteristics of the sole and reduces the wear which is particularly pronounced at the inner ball of the foot of the wearer.

In order to ensure that the outsole according to the invention can also be used advantageously on soft ground, the height of the profile projections should be not less than 4 to 5 mm so that their function corresponds to that of a stud. An advantageous length of the individual profile bodies, for this height, is 12 mm, but a greater or lesser length is also feasible. Favourable conditions, with an advantageous action both on hard ground and on soft ground are achieved if the profile projections are such that if arranged next to one another and behind one another, as shown in FIG. 1, from 50 to 60 projections can be located on the entire outsole. To this extent the representation in FIG. 1 corresponds approximately to life-size.

I claim:

1. An outsole for a sports shoe comprising an outsole member of resilient material having a lower face, a plurality of profile projections projecting out of said lower face, said profile projections each comprising at least two elongate profile bodies of a slender rectangular shape, a plurality of profile projections being located along the edge of the sole, the profile bodies of said projections along the edge of the sole in each case being located close to one another at one end and diverging from one another from said one end under an acute angle between them laterally with respect to the edge of the sole and their height increasing above said lower face of the sole laterally to said edge of the sole.

* * * * *